US010971089B2

(12) United States Patent
Chen

(10) Patent No.: US 10,971,089 B2
(45) **Date of Patent: *Apr. 6, 2021**

(54) DRIVING METHOD OF DISPLAY PANEL AND DISPLAY DEVICE

(71) Applicants: HKC Corporation Limited, Guangdong (CN); Chongqing HKC Optoelectronics Technology Co., Ltd., Chongqing (CN)

(72) Inventor: Yu-Jen Chen, Chongqing (CN)

(73) Assignees: HKC CORPORATION LIMITED, Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/628,559

(22) PCT Filed: Aug. 31, 2017

(86) PCT No.: PCT/CN2017/099917
§ 371 (c)(1),
(2) Date: Jan. 3, 2020

(87) PCT Pub. No.: WO2019/006842
PCT Pub. Date: Jan. 10, 2019

(65) Prior Publication Data

US 2020/0152143 A1 May 14, 2020

(30) Foreign Application Priority Data

Jul. 6, 2017 (CN) ..... 201710547849.4

(51) Int. Cl.
*G09G 3/36* (2006.01)

(52) U.S. Cl.
CPC ..... *G09G 3/3607* (2013.01); *G09G 3/3696* (2013.01); *G09G 2300/0452* (2013.01); *G09G 2320/0242* (2013.01)

(58) Field of Classification Search
CPC ..... G09G 3/3607; G09G 3/3696; G09G 2300/0452; G09G 2320/0242
See application file for complete search history.

(56) References Cited

U.S. PATENT DOCUMENTS

2006/0109224 A1 5/2006 Chang et al.
2009/0167734 A1 7/2009 Chian-Hung et al.
2017/0018238 A1* 1/2017 Kang ..... G09G 3/2074

FOREIGN PATENT DOCUMENTS

CN 102254535 A 11/2011
CN 104299592 A 1/2015
(Continued)

*Primary Examiner* — Robert J Michaud
(74) *Attorney, Agent, or Firm* — Muncy, Geissler, Olds & Lowe, P.C.

(57) ABSTRACT

A driving method of a display panel, comprising: dividing pixels on the display panel into pairs of pixel sets, wherein each pair of pixel sets comprises a first pixel set and a second pixel set; acquiring a first voltage signal and a second voltage signal according to a frame input signal look-up-table, wherein a front viewing-angle mixed brightness of the subpixel driven by the first and second voltage signals alternately is equivalent to a front viewing-angle brightness of the subpixel driven by a frame input signal; driving first subpixels of the first and second pixel sets by first and second voltage signals of the first subpixel of the first pixel set, respectively; and driving second subpixels of the first and second pixel sets by second and first voltage signals of the second subpixel of the second pixel set, respectively.

15 Claims, 4 Drawing Sheets

(56) References Cited

FOREIGN PATENT DOCUMENTS

| | | | |
|---|---|---|---|
| CN | 104317084 | A | 1/2015 |
| CN | 104795037 | A | 7/2015 |
| CN | 104900203 | A | 9/2015 |
| CN | 104952412 | A | 9/2015 |
| CN | 106782371 | A | 5/2017 |

* cited by examiner

DRIVING METHOD OF DISPLAY PANEL AND DISPLAY DEVICE

CROSS REFERENCE TO RELATED APPLICATIONS

This Non-provisional application claims priority on Patent Application No(s). 201710547849.4, entitled "DRIVING METHOD OF DISPLAY PANEL AND DISPLAY DEVICE", filed in People's Republic of China on Jul. 6, 2017, the entire contents of which are hereby incorporated by reference.

BACKGROUND

Technical Field

This disclosure relates to a technical field of a display, and more particularly to a driving method of a display panel and a display device.

Related Art

Most of the current large size LCD display panels adopt the negative type vertical alignment (VA) liquid crystal or the in-plane switching (IPS) liquid crystal technology. Compared with the IPS liquid crystal technology, the VA-type liquid crystal technology has the advantages of the higher production efficiency and the low manufacturing cost, but the more obvious optical property defect. More particularly, the large-size panel needs the larger viewing angle presentation in the commercial application.

The brightness of the VA-type liquid crystal drive at the large viewing angle rapidly saturates with the voltage, thereby causing the seriously deteriorated viewing angle picture quality contrast and color shift as compared with the front-view picture quality.

SUMMARY

According to embodiments of this disclosure, a driving method of a display panel and a display device capable of solving the view-angle color shift is provided.

A driving method of a display panel comprises: dividing pixels on the display panel into a plurality of pairs of pixel sets, wherein each of the pairs of the pixel sets comprises a first pixel set and a second pixel set neighboring upon each other, and each of the first pixel set and the second pixel set comprises a first sub-pixel, a second sub-pixel and a third sub-pixel; acquiring a first voltage signal and a second voltage signal according to a frame input signal look-up-table, wherein the first voltage signal and the second voltage signal are unequal to each other and correspond to each of the sub-pixels, a front viewing-angle mixed brightness of the sub-pixel driven by the first voltage signal and the second voltage signal alternately is equivalent to a front viewing-angle brightness of the sub-pixel driven by a frame input signal; and driving the first sub-pixels of the first pixel set and the second pixel set by a first voltage signal and a second voltage signal of the first sub-pixel of the first pixel set, respectively; and driving the second sub-pixels of the first pixel set and the second pixel set by a second voltage signal and a first voltage signal of the second sub-pixel of the second pixel set, respectively.

A display device comprises a display panel and a drive chip. The pixels on the display panel are divided into a plurality of pairs of pixel sets, each of the pairs of the pixel sets comprises a first pixel set and a second pixel set neighboring upon each other, and each of the first pixel set and the second pixel set comprises a first sub-pixel, a second sub-pixel and a third sub-pixel. The drive chip is configured to acquire a first voltage signal and a second voltage signal according to a frame input signal look-up-table, wherein the first voltage signal and the second voltage signal are unequal to each other and correspond to each of the sub-pixels. The drive chip is further configured to drive the first sub-pixels of the first pixel set and the second pixel set by a first voltage signal and a second voltage signal of the first sub-pixel of the first pixel set, respectively, and configured to drive the second sub-pixels of the first pixel set and the second pixel set by a second voltage signal and a first voltage signal of the second sub-pixel of the second pixel set, respectively. A front viewing-angle mixed brightness of the sub-pixel driven by the first voltage signal and the second voltage signal alternately is equivalent to a front viewing-angle brightness of the sub-pixel driven by a frame input signal.

A driving method of a display panel comprises: dividing pixels on the display panel into a plurality of pairs of pixel sets, wherein each of the pairs of the pixel sets comprises a first pixel set and a second pixel set neighboring upon each other, and each of the first pixel set and the second pixel set comprises a first sub-pixel, a second sub-pixel and a third sub-pixel; and the first sub-pixel is a red sub-pixel, the second sub-pixel is a green sub-pixel, and the third sub-pixel is a blue sub-pixel; acquiring a first voltage signal and a second voltage signal according to a frame input signal look-up-table, wherein the first voltage signal and the second voltage signal are unequal to each other and correspond to each of the sub-pixels, a front viewing-angle mixed brightness of the sub-pixel driven by the first voltage signal and the second voltage signal alternately is equivalent to a front viewing-angle brightness of the sub-pixel driven by a frame input signal; driving the first sub-pixels of the first pixel set and the second pixel set by a first voltage signal and a second voltage signal of the first sub-pixel of the first pixel set, respectively; and driving the second sub-pixels of the first pixel set and the second pixel set by a second voltage signal and a first voltage signal of the second sub-pixel of the second pixel set, respectively; and driving the blue sub-pixels of the first pixel set and the second pixel set by a first voltage signal and a second voltage signal of the blue sub-pixel of the first pixel set, respectively; or driving the blue sub-pixels of the first pixel set and the second pixel set by a second voltage signal and a first voltage signal of the blue sub-pixel of the second pixel set, respectively.

In the above display device and driving method thereof, the pixels on the display panel are divided into a plurality of pairs of pixel sets, each pair of the pixel sets comprises a first pixel set and a second pixel set neighboring upon each other, and each of the first pixel set and the second pixel set comprises a first sub-pixel, a second sub-pixel and a third sub-pixel. The first sub-pixels of the first pixel set and the second pixel set acquire a high voltage signal and a low voltage signal, respectively, and the second sub-pixels of the first pixel set and the second pixel set acquire a low voltage signal and a high voltage signal, respectively. This can obtain a color shift compensation effect.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1:
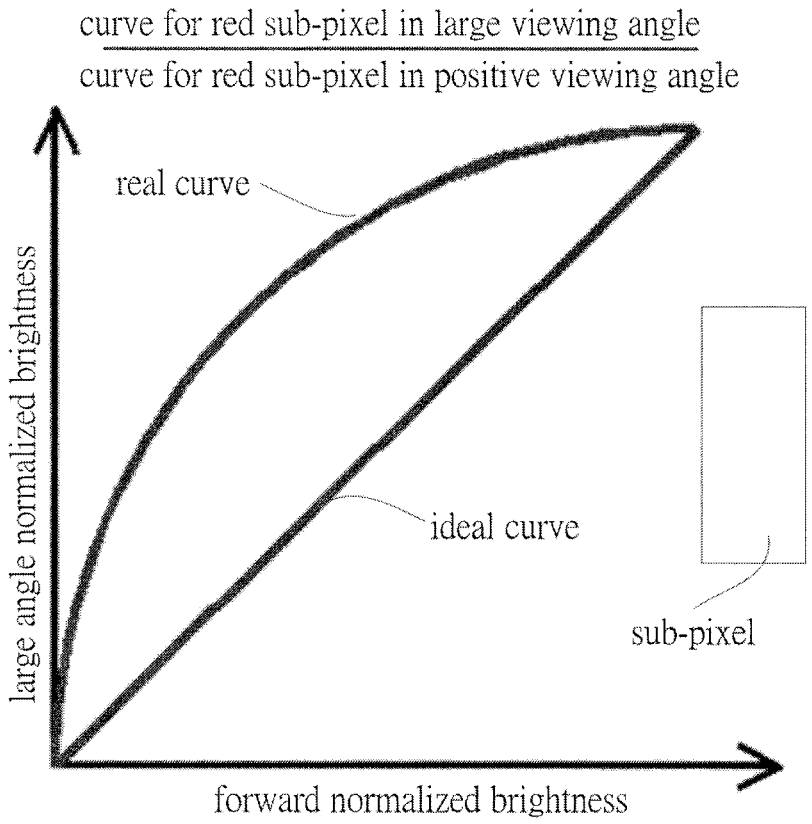
FIG. 1 is a graph showing a front-view and a large-angle view of an exemplary pixel.

Referring to FIG. 1, the brightness of the VA-type liquid crystal drive at the large viewing angle rapidly saturates with the voltage, thereby causing the seriously deteriorated viewing angle picture quality contrast and color shift as compared with the front-view picture quality.

Figure 2:
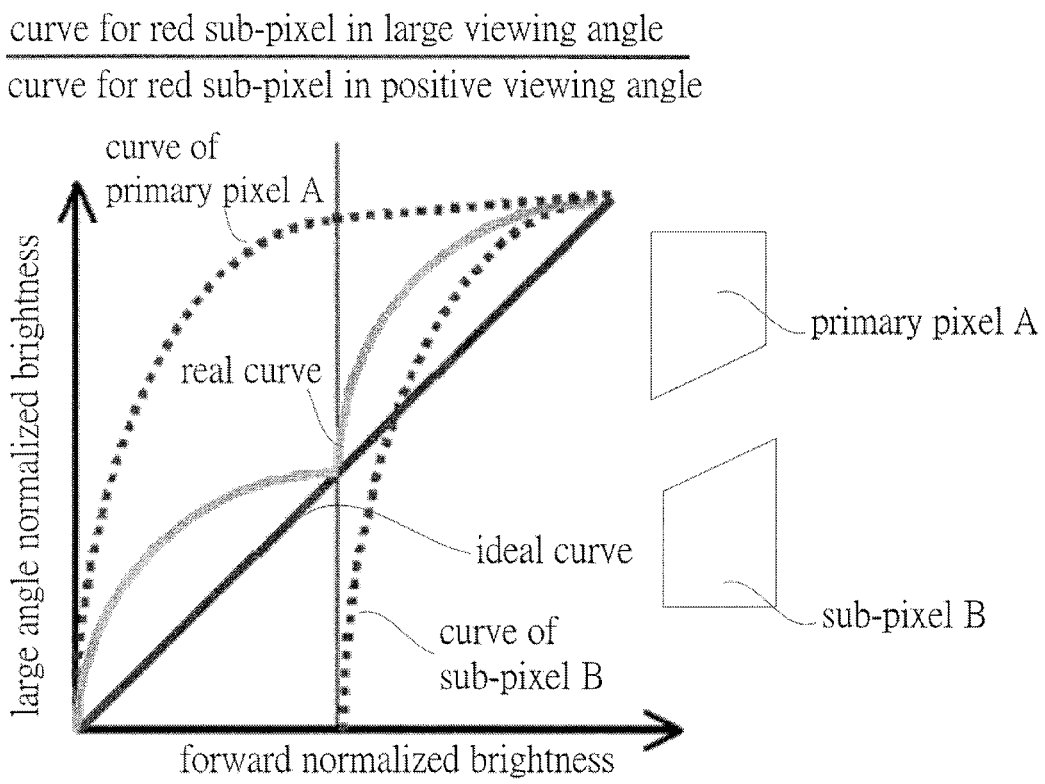
FIG. 2 is a graph showing a front-view and a large-angle view of exemplary primary and secondary pixels.
Figure 3:
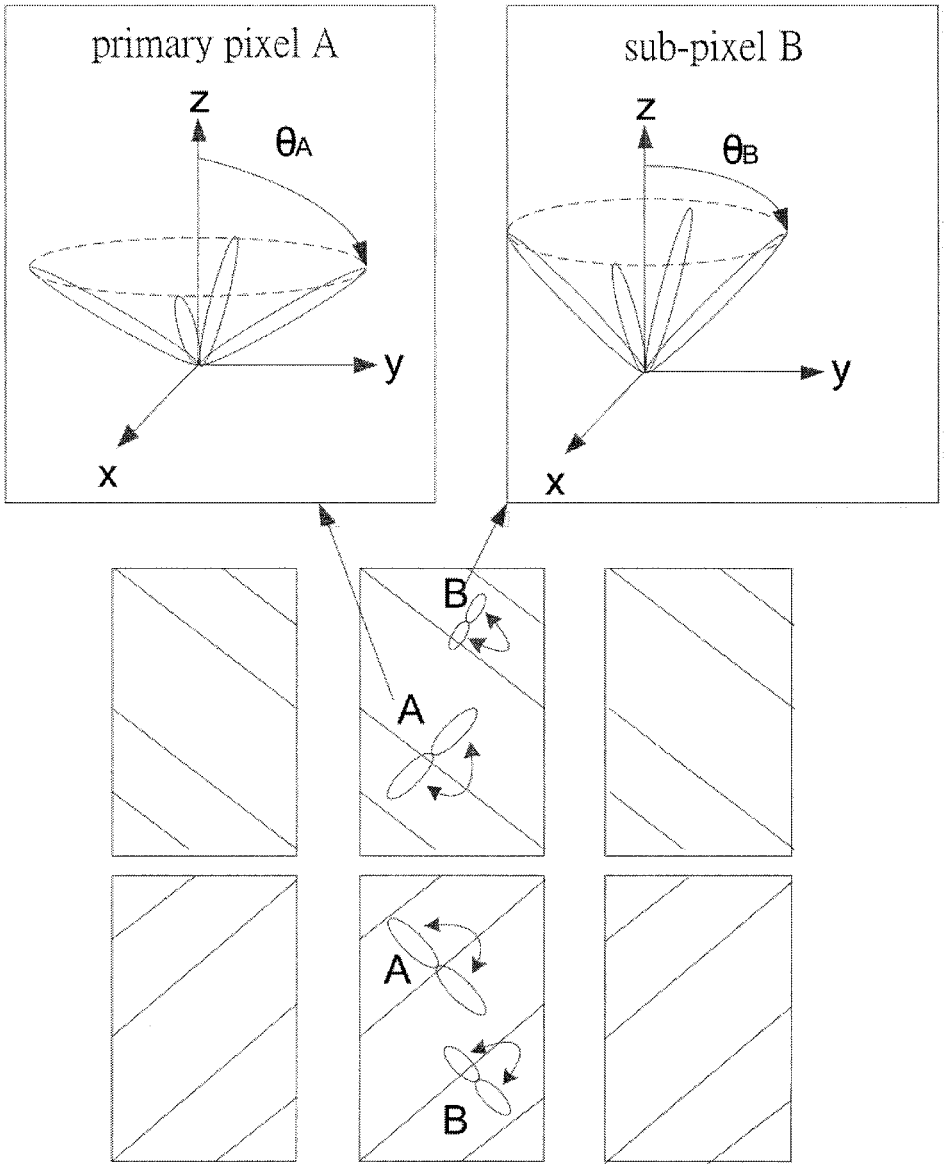
FIG. 3 is a schematic view showing motions of exemplary liquid crystal molecules.

In order to solve the view-angle color shift in the VA-type liquid crystal technology, each of the RGB sub-pixels is divided into a primary pixel and a secondary pixel, and then different drive voltages are provided to the primary pixel and the secondary pixel in the space. FIG. 2 is a graph showing the sub-pixel divided into the primary pixel and the secondary pixel. It is obtained that dividing the sub-pixel into the primary pixel and the secondary pixel can effectively solve the view-angle color shift defect, so that the overall large viewing angle brightness with the voltage change is closer to that of the front view. FIG. 3 is a schematic view showing motions of pixel molecules of the liquid crystal molecules of the RGB sub-pixels in the low gray scale, the middle gray scale and the high gray scale, wherein the motions of the liquid crystal molecules of the primary pixel A and the secondary pixel B of the green sub-pixel G of in the middle gray scale are shown in FIG. 3. However, such the pixel design needs a metal layout or a TFT element to be designed to drive the secondary pixel, thereby sacrificing the light-permeable opening area, affecting the panel permeability, and directly increasing the backlight cost.

Figure 4:
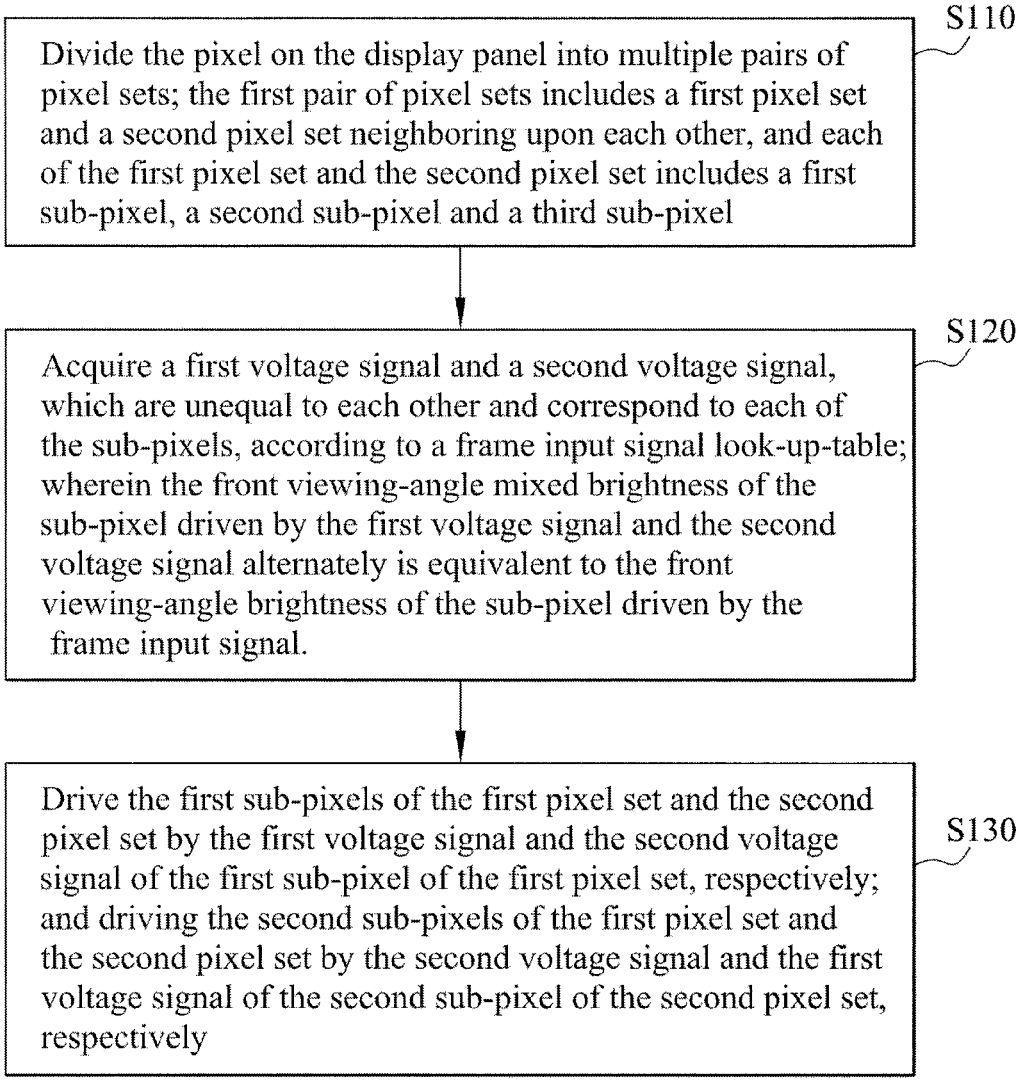
FIG. 4 is a flow chart showing a driving method of a display panel in an embodiment.

Referring to FIG. 4, a driving method of a display panel provided by an embodiment includes the following steps.

In a step S110, the pixels on the display panel are divided into a plurality of pairs of pixel sets. Each pair of pixel sets includes a first pixel set and a second pixel set neighboring upon each other, and each of the first pixel set and the second pixel set includes a first sub-pixel, a second sub-pixel and a third sub-pixel.

In a step S120, a first voltage signal and a second voltage signal, which are unequal to each other and correspond to each of the sub-pixels, are acquired according to a frame input signal look-up-table. The front viewing-angle mixed brightness of the sub-pixel driven by the first voltage signal and the second voltage signal alternately is equivalent to the front viewing-angle brightness of the sub-pixel driven by the frame input signal.

In a step S130, the first sub-pixels of the first pixel set and the second pixel set are driven by the first voltage signal and the second voltage signal of the first sub-pixel of the first pixel set, respectively; and the second sub-pixels of the first pixel set and the second pixel set are driven by the second voltage signal and the first voltage signal of the second sub-pixel of the second pixel set, respectively.

The first sub-pixels of the first pixel set and the second pixel set acquire a high voltage signal and a low voltage signal, respectively, and the second sub-pixels of the first pixel set and the second pixel set acquire a low voltage signal and a high voltage signal, respectively. This can obtain a color shift compensation effect.

Specifically, the first sub-pixel is a red sub-pixel, and the second sub-pixel is a green sub-pixel. According to the three-primary-color (RGB) sub-pixel, since the brightness signals of the red sub-pixel and the green sub-pixel are brighter than the brightness signal of the blue sub-pixel, the red sub-pixel and the green sub-pixel directly affect the viewing image resolution presentation. In the above-mentioned driving method, the red sub-pixels of the first pixel set and the second pixel set respectively acquire one high voltage signal and one low voltage signal, and the green sub-pixels of the first pixel set and the second pixel set respectively acquire one low and one high voltage signals, so that the original image resolution can be maintained, while the compensation effect of the color shift improvement can be obtained.

Regarding the step S120, illustrations will be made by taking the three-primary-color (RGB) display panel and the red sub-pixel as examples. The red sub-pixel signal $R_{i,j}$ is decomposed into a high voltage $RH_{i,j}$ frame and a low voltage $RL_{i,j}$ frame, and the high voltage frame and the low voltage frame are displayed at neighboring two timings in order. The synthesis effect of the high voltage frame and the low voltage frame is equivalent to the brightness of each of the sub-pixels of the original frame. The high voltage frame and low voltage frame signals replace the original frame signal to achieve that the front-view brightness is maintained at the original image signal brightness and unchanged. At the side viewing angle, the high voltage frame and the low voltage frame are displayed through neighboring two timings. According to the application that the low voltage frame viewing angle property can be improved as compared with the saturation phenomenon of the original frame brightness, the viewing angle color difference can be improved. The green sub-pixel and the blue sub-pixel can adopt the method the same as that of the red sub-pixel.

The first and second (high and low) voltage signals of the red sub-pixel R, the green sub-pixel G and the blue sub-pixel B in the frame input signal are the high and low voltage signals which have been previously given according to the input signals of the red sub-pixel R, the green sub-pixel G and the blue sub-pixel B, are determined according to the viewing angle effect, which needs to be compensated, and are generally recorded in the display panel in the form of a look-up table LUT. Further, the look-up table LUT is recorded in the hardware frame buffer of the display panel. For an 8-bit drive signal, each of the red sub-pixel R, the green sub-pixel G and the blue sub-pixel B input signals have the inputs 0 to 255 corresponding to 256 high and low voltage signals, and there are 3*256 pairs of high voltage signals RH, GH, BH and low voltage signals RL, GL, BL in total. The look-up table of the blue sub-pixel is shown in Table 1.

TABLE 1

| input gray | LUT1 | | LUT2 | |
|---|---|---|---|---|
| scale value | BH1 | BL1 | BH2 | BL2 |
| 0 | 0 | 0 | 0 | 0 |
| 1 | 50 | 0 | 40 | 0 |

TABLE 1-continued

| input gray | LUT1 | | LUT2 | |
|---|---|---|---|---|
| scale value | BH1 | BL1 | BH2 | BL2 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

Optionally, the first voltage signal and the second voltage signal corresponding to each of the sub-pixels are acquired according to the frame input signal look-up-table, wherein the front viewing-angle mixed brightness of the first voltage signal and the second voltage signal is equivalent to the front viewing-angle brightness of the frame input signal. Different look-up tables may be selected according to different circumstances, such as the average of the original input gray scale value for one pair of the pixel sets, the average of the original input gray scale value for a plurality of pairs of pixel sets and the like. A plurality of look-up tables, such as 2, 5, 10 look-up tables and the like, may be set according to the requirements. Similarly, a plurality of look-up tables for the red sub-pixel and the green sub-pixel may also be set.

Further, the large viewing angle brightness corresponding to the first voltage signal and the second voltage signal is as close as possible to the front viewing-angle brightness of the original drive data. In an embodiment, the difference between the first voltage signal and the second voltage signal needs to be greater than the predetermined difference range, so as to ensure that the two gray scale values in the target gray scale value pair have a larger gray scale difference. In this embodiment, the large viewing angle can be defined as being greater than 60°, or can be customized by the user.

For example, the first voltage signal is higher than the second voltage signal.

In an embodiment, optionally, as shown in Table 1, the first pixel set is R1,1, G1,1, B1,1, and the second pixel set is R2,1, G2,1, B2,1. As shown in Table 2, the red sub-pixel R1,1 of the first pixel set is driven by the first voltage signal RH1,1 of the red sub-pixel of the first pixel set, and the red sub-pixel R2,1 of the second pixel set is driven by the second voltage signal RL1,1 of the red sub-pixel of the first pixel set. The green sub-pixel G1,1 of the first pixel set is driven by the second voltage signal GL2,1 of the green sub-pixel of the second pixel set, and the green sub-pixel G2,1 of the second pixel set is driven by the first voltage signal GH2,1 of the green sub-pixel of the second pixel set.

Thus, the red sub-pixel R1,1 signal of the first pixel set is reserved, and the red sub-pixel R2,1 signal of the second pixel set are sacrificed. Further, after the red sub-pixel position of the first pixel set is replaced by the high voltage signal (i.e., the first voltage signal RH1,1) obtained from the look-up-table, the original image resolution can be maintained. After the red sub-pixel position of the sacrificed second pixel set is replaced by the low voltage signal (i.e., the second voltage signal RL1,1) obtained from the look-up-table, the compensation effect of the color shift improvement can be obtained.

Similarly, the green sub-pixel G2,1 signal of the second pixel set is reserved, and the green sub-pixel G1,1 signal of the first pixel set is sacrificed. Further, after the green sub-pixel position of the second pixel set is replaced by the high voltage signal (i.e., the first voltage signal GH2,1) obtained from the look-up-table, the original image resolution can be maintained. After the green sub-pixel position of the sacrificed first pixel set is replaced by the low voltage signal (i.e., the second voltage signal GL2,1) obtained from the look-up-table, the compensation effect of the color shift improvement can be obtained. The image content with the maintained resolution can be presented at the original frame signal frequency, and the color shift compensation effect can be obtained without increasing the scan frequency to increase the frame content and maintain the original frame resolution and obtain the color shift improvement effect.

The blue sub-pixel mainly plays the role for color presentation, and does not significantly affect the presentation of the watched image resolution. One of the blue sub-pixels of the neighboring first pixel set and second pixel set, such as B1,1, B2,1 in Table 2, may serve as the main image resolution representative of the signal presentation.

Optionally, the blue sub-pixels of the first pixel set and the second pixel set, such as B1,1, B2,1 in Table 2, are respectively driven by the first voltage signal and the second voltage signal of the blue sub-pixel of the first pixel set, such as BH1,1, BL1,1 in Table 3. The blue sub-pixel changes with the red sub-pixel, is applicable to the display panels having a brighter green sub-pixel brightness, and is also applicable to red-green-blue arranged display panels.

Optionally, the blue sub-pixels of the first pixel set and the second pixel set are respectively driven by the second voltage signal and the first voltage signal of the blue sub-pixel of the second pixel set. The blue sub-pixel changes with the green sub-pixel, is applicable to the display panels having a brighter red sub-pixel brightness, and is also applicable to green-red-blue arranged display panels.

Optionally, the blue sub-pixel can also be driven using the original frame input signal.

TABLE 2

| | | | | | | | | |
|---|---|---|---|---|---|---|---|---|
| R1,1 | G1,1 | B1,1 | R1,2 | G1,2 | B1,2 | R1,3 | G1,3 | B1,3 |
| R2,1 | G2,1 | B2,1 | R2,2 | G2,2 | B2,2 | R2,3 | G2,3 | B2,3 |
| R3,1 | G3,1 | B3,1 | R3,2 | G3,2 | B3,2 | R3,3 | G3,3 | B3,3 |
| R4,1 | G4,1 | B4,1 | R4,2 | G4,2 | B4,2 | R4,3 | G4,3 | B4,3 |
| R5,1 | G5,1 | B5,1 | R5,2 | G5,2 | B5,2 | R5,3 | G5,3 | B5,3 |

TABLE 3

| | | | | | | | | |
|---|---|---|---|---|---|---|---|---|
| RH1,1 | GL2,1 | BH1,1 | RL2,2 | GH1,2 | BL2,2 | RH1,3 | GL2,3 | BH1,3 |
| RL1,1 | GH2,1 | BL1,1 | RH2,2 | GL1,2 | BH2,2 | RL1,3 | GH2,3 | BL1,3 |
| RH3,1 | GL4,1 | BH3,1 | RL4,2 | GH3,2 | BL4,2 | RH3,3 | GL4,3 | BH3,3 |
| RL3,1 | GH4,1 | BL3,1 | RH4,2 | GL3,2 | BH4,2 | RL3,3 | GH4,3 | BL3,3 |
| RH5,1 | GL6,1 | BH5,1 | RL6,2 | GH5,2 | BL6,2 | RH5,3 | GL6,3 | BH5,3 |

Optionally, the first pixel set and the second pixel set can be disposed in the same column and neighbor upon each other (i.e., longitudinally disposed and neighbor upon each other). The first pixel set is R1,1, G1,1, B1,1, and the second pixel set is R2,1, G2,1, B2,1. As shown in Table 3, the red sub-pixel R1,1 of the first pixel set is driven by the first voltage signal RH1,1 of the red sub-pixel of the first pixel set, and the red sub-pixel R2,1 of the second pixel set is driven by the second voltage signal RL1,1 of the red sub-pixel of the first pixel set. The green sub-pixel G1,1 of the first pixel set is driven by the second voltage signal GL2,1 of the green sub-pixel of the second pixel set, and the green sub-pixel G2,1 of the second pixel set is driven by the first voltage signal GH2,1 of the green sub-pixel of the second pixel set. Further, in neighboring two pairs of pixel sets, the first pixel set of one pair of pixel sets and the second pixel set of the other pair of pixel sets are disposed adjacent to each other (i.e., the first pixel sets of the neighboring two pairs of pixel sets are staggered). In the transversally neighboring two pairs of pixel sets, one pair of first pixel sets is disposed above the second pixel set, and the first pixel set of the other pair of pixel sets is disposed under the second pixel set. The first pixel sets for implementing the neighboring pixel sets are staggered.

Optionally, the first pixel set and the second pixel set can be disposed in the same row and neighbor upon each other (i.e., transversally disposed adjacent to each other). As shown in Table 2, the first pixel set is R1,1, G1,1, B1,1, and the second pixel set is R2,1, G2,1, B2,1. As shown in Table 4, the red sub-pixel R1,1 of the first pixel set is driven by the first voltage signal RH1,1 of the red sub-pixel of the first pixel set, and the red sub-pixel R2,1 of the second pixel set is driven by the second voltage signal RL1,1 of the red sub-pixel of the first pixel set. The green sub-pixel G1,1 of the first pixel set is driven by the second voltage signal GL2,1 of the green sub-pixel of the second pixel set, and the green sub-pixel G2,1 of the second pixel set is driven by the first voltage signal GH2,1 of the green sub-pixel of the second pixel set.

Further, in neighboring two pairs of pixel sets, the first pixel set of one pair of pixel sets and the second pixel set of the other pair of pixel sets are disposed adjacent to each other (i.e., the first pixel sets of the neighboring two pairs of pixel sets are staggered). In the vertically neighboring two pairs of pixel sets, one pair of first pixel sets is disposed at the right side of the second pixel set, and the first pixel set of the other pair of pixel sets is disposed at the left side of the second pixel set. The first pixel sets for implementing the neighboring pixel sets are staggered.

TABLE 4

| | | | | | | | | |
|---|---|---|---|---|---|---|---|---|
| RH1,1 | GL1,2 | BH1,1 | RL1,1 | GH1,2 | BL1,1 | RH1,3 | GL1,4 | BH1,3 |
| RL2,2 | GH2,1 | BL2,2 | RH2,2 | GL2,1 | BH2,2 | RL2,4 | GH2,3 | BL2,4 |
| RH3,1 | GL3,2 | BH3,1 | RL3,1 | GH3,2 | BL3,1 | RH3,3 | GL3,4 | BH3,3 |
| RL4,2 | GH4,1 | BL4,2 | RH4,2 | GL4,1 | BH4,2 | RL4,4 | GH4,3 | BL4,4 |
| RH5,1 | GL5,1 | BH5,1 | RL5,1 | GH5,2 | BL5,1 | RH5,3 | GL5,4 | BH5,3 |

In the above-mentioned embodiment, the first voltage signal being smaller than the second voltage signal may be replaced with the first voltage signal being greater than the second voltage signal.

In the above-mentioned embodiment, the positions of the first pixel set and the second pixel set in the pixel set can be exchanged. Specifically, includes:

The main difference from the previous embodiment is that: the red sub-pixel of the second pixel set is driven by the first voltage signal of the red sub-pixel of the second pixel set; and the red sub-pixel of the first pixel set is driven by the second voltage signal of the red sub-pixel of the second pixel set. The green sub-pixel of the second pixel set is driven by the second voltage signal of the green sub-pixel of the first pixel set; and the green sub-pixel the first pixel set is driven by the first voltage signal of the green sub-pixel of the first pixel set.

The main difference from the previous embodiment is that: the red sub-pixel of the second pixel set is driven by the first voltage signal of the red sub-pixel of the first pixel set; and the red sub-pixel of the first pixel set is driven by the second voltage signal of the red sub-pixel of the first pixel set. The green sub-pixel of the second pixel set is driven by the second voltage signal of the green sub-pixel of the second pixel set; and the green sub-pixel the first pixel set is driven by the first voltage signal of the green sub-pixel of the second pixel set.

The main difference from the previous embodiment is that: the red sub-pixel of the second pixel set is driven by the second voltage signal of the red sub-pixel of the second pixel set; and the red sub-pixel of the first pixel set is driven by the first voltage signal of the red sub-pixel of the second pixel set. The green sub-pixel of the second pixel set is driven by the first voltage signal of the green sub-pixel of the first pixel set; and the green sub-pixel the first pixel set is driven by the second voltage signal of the green sub-pixel of the first pixel set.

The driving method of the display panel can improve the drawback of the color shift or the color difference caused by the mismatched refractive indexes of the display panel at the large viewing angle. The display panel can be a twisted nematic (TN), an optically compensated birefringence (OCB) or a vertical alignment (VA) type liquid crystal display panel. The display panel may also be, for example, an organic light emitting diode (OLED) display panel, a quantum dots light-emitting diode (QLED) display panel or other display panels, but is not limited thereto. The driving method is also applicable when the display panel is a curved surface panel.

Figure 5:
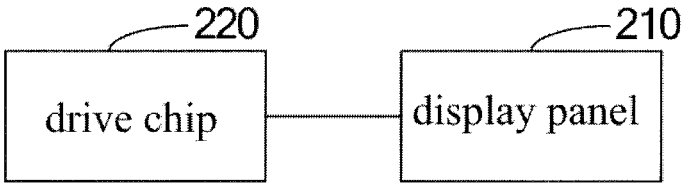
FIG. 5 is a block diagram showing a display device in another embodiment.

Referring to FIG. 5, another embodiment provides a display device, which includes a display panel 210 and a drive chip 220. Herein, the pixels on the display panel 210 are divided into a plurality of pairs of pixel sets. Each pair of pixel sets includes a first pixel set and a second pixel set neighboring upon each other, and each of the first pixel set and the second pixel set includes a first sub-pixel, a second sub-pixel and a third sub-pixel.

The drive chip 220 is configured to acquire a first voltage signal and a second voltage signal, which are unequal to each other and correspond to each of the sub-pixels, according to frame input signal look-up-table; is configured to drive the first sub-pixels of the first pixel set and the second pixel set by the first voltage signal and the second voltage signal of the first sub-pixel of the first pixel set, respectively; and is also configured to drive the second sub-pixels of the first pixel set and the second pixel set by the second voltage signal and the first voltage signal of the second sub-pixel of the second pixel set, respectively. The front viewing-angle mixed brightness of the sub-pixel driven by the first voltage signal and the second voltage signal alternately is equivalent to the front viewing-angle brightness of the sub-pixel driven by the frame input signal.

Specifically, the first sub-pixel is a red sub-pixel, and the second sub-pixel is a green sub-pixel. According to the three-primary-color (RGB) sub-pixel, since the brightness signals of the red sub-pixel and the green sub-pixel are brighter than the brightness signal of the blue sub-pixel, the red sub-pixel and the green sub-pixel directly affect the viewing image resolution presentation. In the above-mentioned driving method, the red sub-pixels of the first pixel set and the second pixel set respectively acquire one high voltage signal and one low voltage signal, and the green sub-pixels of the first pixel set and the second pixel set respectively acquire one low and one high voltage signals, so that the original image resolution can be maintained, while the compensation effect of the color shift improvement can be obtained.

Optionally, the third sub-pixel is the blue sub-pixel. The drive chip 220 is also configured to drive the blue sub-pixels of the first pixel set and the second pixel set, such as B1,1, B2,1 in Table 2, by the first voltage signal and the second voltage signal of the blue sub-pixel of the first pixel set, such as BH1,1, BL1,1 in Table 3, respectively. The blue sub-pixel changes with the red sub-pixel, is applicable to the display panels having a brighter green sub-pixel brightness, and is also applicable to red-green-blue arranged display panels.

Optionally, the drive chip 220 is also configured to drive the blue sub-pixels of the first pixel set and the second pixel set by the second voltage signal and the first voltage signal of the blue sub-pixel of the second pixel set, respectively.

Optionally, the first pixel set and the second pixel set of the display panel 210 can be disposed in the same column and neighbor upon each other (i.e., longitudinally disposed and neighbor upon each other). The first pixel set is R1,1, G1,1, B 1,1, and the second pixel set is R2,1, G2,1, B2,1. As shown in Table 3, the red sub-pixel R1,1 of the first pixel set is driven by the first voltage signal RH1,1 of the red sub-pixel of the first pixel set, and the red sub-pixel R2,1 of the second pixel set is driven by the second voltage signal RL1,1 of the red sub-pixel of the first pixel set. The green sub-pixel G1,1 of the first pixel set is driven by the second voltage signal GL2,1 of the green sub-pixel of the second pixel set, and the green sub-pixel G2,1 of the second pixel set is driven by the first voltage signal GH2,1 of the green sub-pixel of the second pixel set. Further, in neighboring two pairs of pixel sets, the first pixel set of one pair of pixel sets and the second pixel set of the other pair of pixel sets are disposed adjacent to each other (i.e., the first pixel sets of the neighboring two pairs of pixel sets are staggered). In the transversally neighboring two pairs of pixel sets, one pair of first pixel sets is disposed above the second pixel set, and the first pixel set of the other pair of pixel sets is disposed under the second pixel set. The first pixel sets for implementing the neighboring pixel sets are staggered.

Optionally, the first pixel set and the second pixel set of the display panel 210 can be disposed in the same row and neighbor upon each other (i.e., transversally disposed adjacent to each other). As shown in Table 2, the first pixel set is R1,1, G1,1, B1,1, and the second pixel set is R2,1, G2,1, B2,1. As shown in Table 4, the red sub-pixel R1,1 of the first pixel set is driven by the first voltage signal RH1,1 of the red sub-pixel of the first pixel set, and the red sub-pixel R2,1 of the second pixel set is driven by the second voltage signal RL1,1 of the red sub-pixel of the first pixel set. The green sub-pixel G1,1 of the first pixel set is driven by the second voltage signal GL2,1 of the green sub-pixel of the second pixel set, and the green sub-pixel G2,1 of the second pixel set is driven by the first voltage signal GH2,1 of the green sub-pixel of the second pixel set.

Further, in neighboring two pairs of pixel sets of the display panel 210, the first pixel set of one pair of pixel sets and the second pixel set of the other pair of pixel sets are disposed adjacent to each other (i.e., the first pixel sets of the neighboring two pairs of pixel sets are staggered). In the vertically neighboring two pairs of pixel sets, one pair of first pixel sets is disposed at the right side of the second pixel set, and the first pixel set of the other pair of pixel sets is disposed at the left side of the second pixel set. The first pixel sets for implementing the neighboring pixel sets are staggered.

Further, the difference between the first voltage signal and the second voltage signal is greater than the predetermined difference range.

The display device can improve the drawback of the color shift or the color difference caused by the mismatched refractive indexes of the display panel at the large viewing angle. The display panel can be a TN type liquid crystal display panel, an OCB type liquid crystal display panel, or a VA type liquid crystal display panel. The display panel can also be, for example, an OLED display panel, a QLED display panel, a curved display panel, or other display panels. This disclosure is not limited.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving method of a display panel, comprising:

dividing pixels on the display panel into a plurality of pairs of pixel sets, wherein each of the pairs of the pixel sets comprises a first pixel set and a second pixel set neighboring upon each other, and each of the first pixel set and the second pixel set comprises a first sub-pixel, a second sub-pixel and a third sub-pixel;

acquiring a first voltage signal and a second voltage signal according to a frame input signal look-up-table, wherein the first voltage signal and the second voltage signal are unequal to each other and correspond to each of the sub-pixels, a front viewing-angle mixed brightness of the sub-pixel driven by the first voltage signal and the second voltage signal alternately is equivalent to a front viewing-angle brightness of the sub-pixel driven by a frame input signal; and driving the first sub-pixels of the first pixel set and the second pixel set by a first voltage signal and a second voltage signal of the first sub-pixel of the first pixel set, respectively; and driving the second sub-pixels of the first pixel set and the second pixel set by a second voltage signal and a first voltage signal of the second sub-pixel of the second pixel set, respectively, wherein the first sub-pixels of the first pixel set and the second pixel set acquire a high voltage signal and a low voltage signal, respectively, and the second sub-pixels of the first pixel set and the second pixel set acquire a low voltage signal and a high voltage signal, respectively, to obtain a color shift compensation effect.

2. The method according to claim 1, wherein the first sub-pixel is a red sub-pixel, and the second sub-pixel is a green sub-pixel.

3. The method according to claim 2, wherein the third sub-pixel is a blue sub-pixel, and the blue sub-pixels of the first pixel set and the second pixel set are driven by a first voltage signal and a second voltage signal of the blue sub-pixel of the first pixel set, respectively.

4. The method according to claim 1, wherein the first pixel set and the second pixel set are disposed in the same row and neighbor upon each other.

5. The method according to claim 1, wherein the first pixel set and the second pixel set are disposed in the same column and neighbor upon each other.

6. The method according to claim 1, wherein in neighboring two of the pairs of the pixel sets, the first pixel set of one of the two pairs of the pixel sets and the second pixel set of the other one of the two pairs of the pixel sets are disposed adjacent to each other.

7. The method according to claim 1, wherein a difference between the first voltage signal and the second voltage signal is greater than a predetermined difference range.

8. A display device, comprising:

a display panel, wherein pixels on the display panel are divided into a plurality of pairs of pixel sets, each of the pairs of the pixel sets comprises a first pixel set and a second pixel set neighboring upon each other, and each of the first pixel set and the second pixel set comprises a first sub-pixel, a second sub-pixel and a third sub-pixel; and a drive chip configured to acquire a first voltage signal and a second voltage signal according to a frame input signal look-up-table, wherein the first voltage signal and the second voltage signal are unequal to each other and correspond to each of the sub-pixels;

configured to drive the first sub-pixels of the first pixel set and the second pixel set by a first voltage signal and a second voltage signal of the first sub-pixel of the first pixel set, respectively; and configured to drive the second sub-pixels of the first pixel set and the second pixel set by a second voltage signal and a first voltage signal of the second sub-pixel of the second pixel set, respectively; wherein a front viewing-angle mixed brightness of the sub-pixel driven by the first voltage signal and the second voltage signal alternately is equivalent to a front viewing-angle brightness of the sub-pixel driven by a frame input signal, wherein the first sub-pixels of the first pixel set and the second pixel set acquire a high voltage signal and a low voltage signal, respectively, and the second sub-pixels of the first pixel set and the second pixel set acquire a low voltage signal and a high voltage signal, respectively, to obtain a color shift compensation effect.

9. The display device according to claim 8, wherein the first sub-pixel is a red sub-pixel, and the second sub-pixel is a green sub-pixel.

10. The display device according to claim 9, wherein the third sub-pixel is a blue sub-pixel, and the drive chip is further configured to drive the blue sub-pixels of the first pixel set and the second pixel set by a first voltage signal and a second voltage signal of the blue sub-pixel of the first pixel set, respectively.

11. The display device according to claim 8, wherein the first pixel set and the second pixel set are disposed in the same row and neighbor upon each other.

12. The display device according to claim 8, wherein the first pixel set and the second pixel set are disposed in the same column and neighbor upon each other.

13. The display device according to claim 8, wherein in neighboring two of the pairs of the pixel sets, the first pixel set of one of the two pairs of the pixel sets and the second pixel set of the other one of the two pairs of the pixel sets are disposed adjacent to each other.

14. The display device according to claim 8, wherein a difference between the first voltage signal and the second voltage signal is greater than a predetermined difference range.

15. A driving method of a display panel, comprising:

dividing pixels on the display panel into a plurality of pairs of pixel sets, wherein each of the pairs of the pixel sets comprises a first pixel set and a second pixel set neighboring upon each other, and each of the first pixel set and the second pixel set comprises a first sub-pixel, a second sub-pixel and a third sub-pixel; and the first sub-pixel is a red sub-pixel, the second sub-pixel is a green sub-pixel, and the third sub-pixel is a blue sub-pixel;

acquiring a first voltage signal and a second voltage signal according to a frame input signal look-up-table, wherein the first voltage signal and the second voltage signal are unequal to each other and correspond to each of the sub-pixels, a front viewing-angle mixed brightness of the sub-pixel driven by the first voltage signal and the second voltage signal alternately is equivalent to a front viewing-angle brightness of the sub-pixel driven by a frame input signal;

driving the first sub-pixels of the first pixel set and the second pixel set by a first voltage signal and a second voltage signal of the first sub-pixel of the first pixel set, respectively; and driving the second sub-pixels of the first pixel set and the second pixel set by a second voltage signal and a first voltage signal of the second sub-pixel of the second pixel set, respectively; and driving the blue sub-pixels of the first pixel set and the second pixel set by a first voltage signal and a second voltage signal of the blue sub-pixel of the first pixel set, respectively; or driving the blue sub-pixels of the first pixel set and the second pixel set by a second voltage signal and a first voltage signal of the blue sub-pixel of the second pixel set, respectively, wherein the first sub-pixels of the first pixel set and the second pixel set acquire a high voltage signal and a low voltage signal, respectively, and the second sub-pixels of the first pixel set and the second pixel set acquire a low voltage signal and a high voltage signal, respectively, to obtain a color shift compensation effect.

* * * * *